United States Patent [19]

Breck, Jr.

[11] 4,034,690

[45] July 12, 1977

[54] APPARATUS AND METHOD FOR FORMING BELT LOOPS

[76] Inventor: Louis William Breck, Jr., P.O. Box 9817, El Paso, Tex. 79988

[21] Appl. No.: 587,743

[22] Filed: June 17, 1975

[51] Int. Cl.[2] ..... D05B 35/00

[52] U.S. Cl. ..... 112/121.27; 112/147

[58] Field of Search ..... 112/121.27, 147, 121.11, 112/203, 2, 121.29, 130, DIG. 2; 270/93

[56] References Cited

U.S. PATENT DOCUMENTS

| | | | |
|---|---|---|---|
| 3,463,482 | 8/1969 | Baron et al. | 112/147 X |
| 3,531,107 | 9/1970 | Rovin et al. | 112/DIG. 2 |
| 3,544,098 | 12/1970 | Hawley et al. | 112/DIG. 2 |
| 3,583,341 | 6/1971 | Birdsong et al. | 112/121.27 X |
| 3,898,941 | 8/1975 | Crawford et al. | 112/121.29 |

*Primary Examiner*—Werner H. Schroeder
*Assistant Examiner*—Peter Nerbun
*Attorney, Agent, or Firm*—Allen D. Brufsky

[57] ABSTRACT

An apparatus and method for forming belt loops from fabric cut to the exact length of the finished loop. Single fabric plies are sequentially fed by pneumatic means into stationary alignment with a folder. While the alignment is maintained, the plies are transported through the folder where opposed longitudinal edges of the ply are overlapped to present one exposed edge to a sewing device. The exposed edge is positioned by its alignment to be completely covered by stitches to form the finished loop and to prevent unravelling of the exposed edge when the loop is attached to a garment.

8 Claims, 11 Drawing Figures

APPARATUS AND METHOD FOR FORMING BELT LOOPS

BACKGROUND OF THE INVENTION

1. Field of the Invention

This invention relates to an apparatus and method for making belt loops from discrete, properly-sized plies of fabric material.

2. Description of Prior Art

Presently, belt loops are made either from fabric material cut from the lay, which must have at least a minimum length to permit machine handling of the material or from a roll of continuous fabric material. Both methods are undesirable since they do not utilize the fabric material to the fullest extent.

Present processes for forming belt loops from fabric material require, for safety and handling reasons, that the material have an oversize length which permits the pliable fabric to be hand-fed into available folding and sewing apparatus. In these processes, the oversized fabric pieces are folded into the desired configuration and then are sewn to form a belt loop blank. The pliable pieces are sequentially passed through the folding and sewing apparatus and each is overlapped onto the preceding and succeeding blank and sewn together to form a unit and piece of sewn fabric. This piece then is cut to form discrete satisfactory belt loops and the remaining pieces containing the overlapped ends are discarded since they are not usable as belt loops. If it were not necessary to overlap and sew the individual pieces, it is obvious that a greater amount of the fabric material could be utilized to form the belt loops, resulting in significant cost savings of fabric.

Further savings can be achieved through improved material utilization. In the art of cutting garment parts from the fabric, the patterns for the various parts are arranged on the cloth in such a way as to leave as little waste area between the patterns as possible. It is a well known principle of this art that multiple small patterns result in less waste than a single large pattern of the same area as the combined areas of the smaller patterns. Thus the smaller size of belt loop blank allows greater material utilization as compared to the larger blank. Stated in another way, the small patterns of the individual belt loops may be nested among the larger garment part patterns in such a way that the belt loop utilizes fabric which would otherwise be wasted. Therefore, if the fabric blanks could be cut to the exact width and length needed to form a completed belt loop and a machine designed to use such blanks, significant cost savings of material could be realized.

The alternative process for forming belt loops from a roll of fabric material is even more undesirable than the above-described process. This alternative requires the use of virgin fabric rather than permitting the use of small patterns of fabric nested among larger patterns, and is much more expensive since it results in even greater fabric waste.

Prior attempts to utilize fabric pieces having an exact length and width suitable for folding and sewing into individual belt loops have not been successful because no suitable means has been provided for safely and consistently automatically feeding, positioning, aligning, and spacing the discrete, exact length and width fabric pieces for subsequent folding and sewing.

In such a device, I have found that it is preferable for the fabric piece to be positioned so that the longitudinal edges of the piece can be overlapped along its entire length to present one rather than two edges to be stitched or sewn. Thus, when the leading edge of the fabric piece is not properly aligned with the folder, the desired overlapping of the longitudinal edges is not attained. Furthermore, when the fabric piece is not properly centered with respect to the folder and/or sewing apparatus, the exposed overlapped longitudinal edge of the folded piece will not be centered properly for subsequent sewing. In either event, when the folded piece is subsequently sewn, the exposed overlapped edge will not be stitched across the exposed edge and the free unsewn edge can become unravelled during use.

Further, the fabric pieces must be automatically spaced and not overlapped.

Accordingly, it would be highly desirable to provide a means for forming belt loops from fabric material which does not require having a length greater than that of normal belt loops, and which does not require that the pieces be overlapped prior to being sewn. Such a means would maximize fabric utilization and result in significant cost savings. However, such an apparatus should meet the alignment and spacing criteria set out above.

SUMMARY OF THE INVENTION

The present invention provides a method and apparatus for forming belt loops which meets these criteria. The belt loops are formed from fabric plies having the exact length of the belt loop cut from the fabric.

The fabric ply is aligned with a folder by pneumatic jets and then transported to the folder by a ram which positions the aligned ply on a conveyor belt feeding the folder.

The longitudinal edges of the fabric are overlapped by the folder along their length. The folded fabric ply is then fed to a sewing means positioned to form stitches over the overlapped edge along its entire length while the desired alignment is retained.

A photoelectric cell senses the trailing edge of the ply fed to the folder to cause actuation of the ram to position a succeeding aligned ply on the conveyor belt feeding the folder so the plies are fed in spaced relationship.

DESCRIPTION OF THE DRAWINGS

Reference is made to the accompanying drawings for a more detailed description of the invention wherein.

DESCRIPTION OF THE PREFERRED EMBODIMENT

Figure 1:
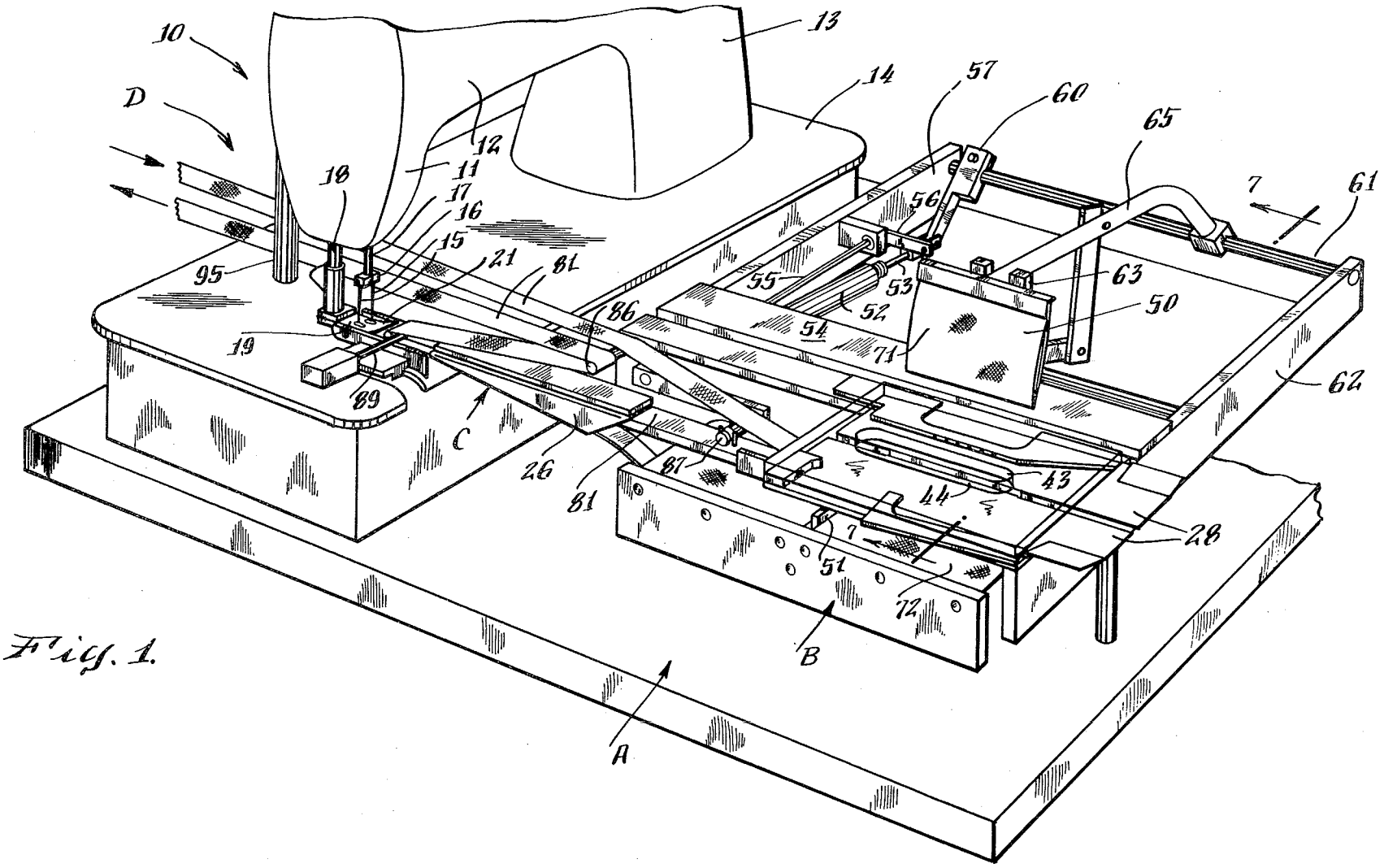
FIG. 1 is a perspective view of the apparatus of the present invention including the alignment means, folding means, and sewing means of the invention.

Referring specifically to the drawings, wherein like numerals indicate like elements throughout the several views, FIG. 1 illustrates an apparatus generally designated by the letter A for forming belt loops from single fabric plies. Apparatus A includes a fabric ply alignment Section B, a folding Section C, and a sewing Section D.

Sewing Section D comprises a conventional sewing machine 10, including a head 11 supported by arm 12, standard 13 and bed plate 14. Two needles 15 are supported by needle clamp 16 and needle bar 17, which is slidingly supported within head 11. The needles 15 are subjected to working movement by conventional drive mechanisms, which are well known in such machines. Presser foot bar 18 which supports presser foot 19 also is carried by head 11. The sewing machine 10 is provided with conventional work-feeding mechanisms (not shown) such as a feed dog, which, together with the presser foot 19, feeds a fabric piece into contact with the sewing needles 15 in order to effect stitching of the fabric piece. The presser foot 19 is located with a guide 20, which is provided with guide rails 21. A belt 81 functions to feed a folded fabric piece from a folder 26 at folding Section C into contact with the needles 15 to form a stitched belt loop in a manner which will be described in greater detail below.

The apparatus positioned at alignment Section B functions to align single fabric plies cut to the exact length and width of the finished belt loop by pneumatic means with folder 26 and then position the ply on a conveyor belt 72 whereby the aligned ply is transported to folder 26.

Fabric plies F cut to the exact length of the finished belt loop are placed on a platform defined by plates 28 and fed sequentially through an opening 27 into an alignment chamber 29, generally defined by a top plate 30, a bottom plate 31 and an end wall 32. The feeding of the fabric plies through opening 27 is effected by any suitable mechanical means such as a moving belt (not shown) or by hand.

Figure 2:
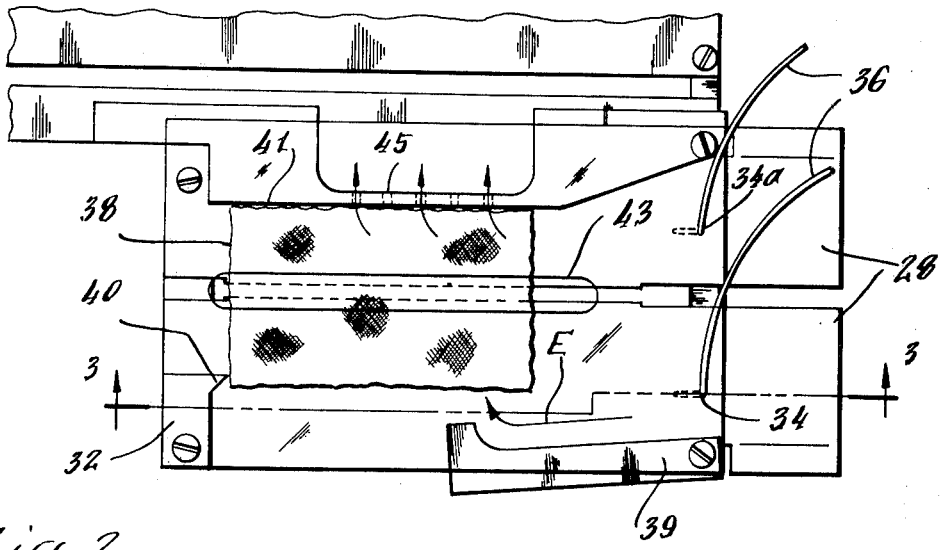
FIG. 2 is a top plan view of a portion of the alignment means of the apparatus shown in FIG. 1.
Figure 3:
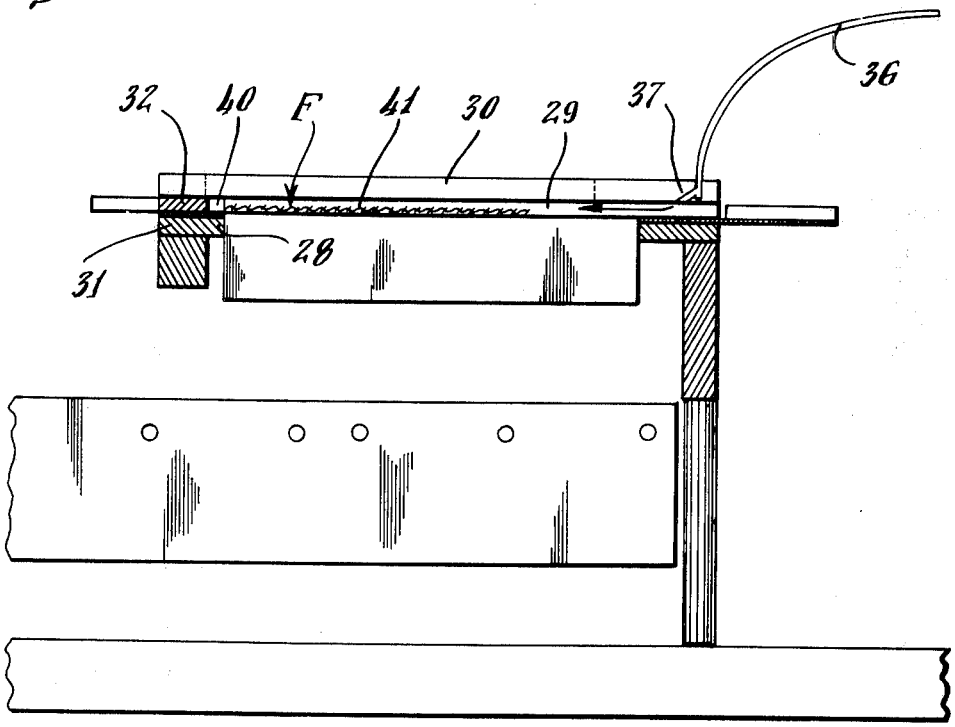
FIG. 3 is a cross-sectional view of a portion of the alignment means of the apparatus taken along line 3—3 of FIG. 2.
Figure 4:
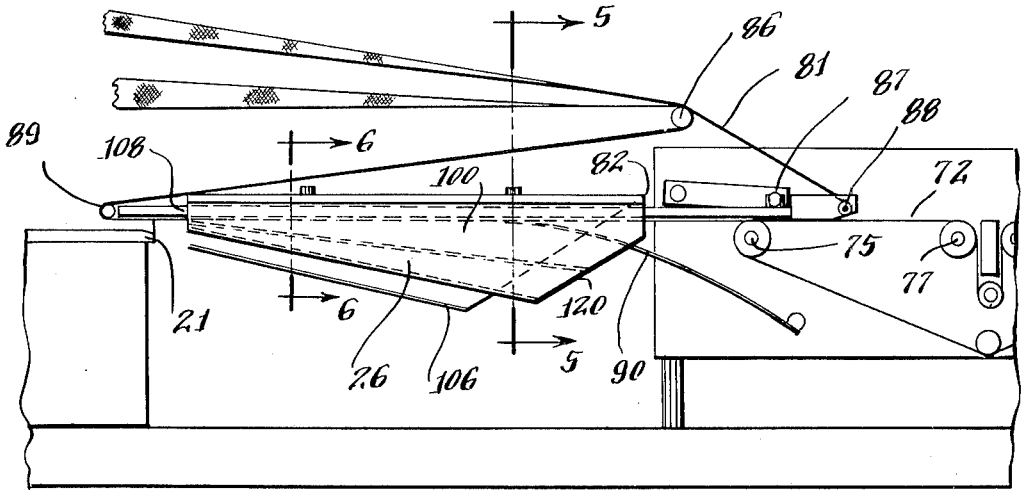
FIG. 4 is a side view in elevation of the folding means of the apparatus shown in FIG. 1.

Pneumatic means 34 and **34*a* are provided adjacent opening 27 to align ply F fed through opening 27 with folder 26 and comprises hoses 36 connected to a source of pressurized fluid (not shown). The fluid is directed through conduits 37 formed in top plate 30 of alignment chamber 29 into the chamber and contacts fabric ply F to direct it toward wall 32. Fluid exiting from conduits 37 also strikes a deflector 39 and as shown by the Arrow E in FIG. 2 directs a portion of the fluid normal to the general direction of movement of fabric ply F. Under the influence of the fluid flow, the leading edge 38 of fabric ply F is positioned squarely against a stop 40, projecting from wall 32 and the inner edge of a wall 41, so that ply F is centered under an axially extending opening 43 in top plate 30 and over a complemental opening 44 in bottom plate 31 of alignment chamber 29. The effluent fluid is removed from chamber 29 through ports 45 and vented to the atmosphere. Plates 30 and 31 are preferably formed from a transparent material such as clear plastic to enable the operator to view the position of the fabric ply F in the chamber 29**.

After the fabric ply F has been aligned, it is transported to the folder 26 and sewing machine 10. Folder 26 folds the ply F into a belt loop by overlapping the longitudinal edges of the ply. The exposed longitudinal edge is stitched by sewing needles 15 so that the stitches cover the entire exposed edge of the ply F.

The aligned ply F is transported to the folder 26, first by being contacted with a transfer blade or ram 50 when it is actuated to move in a downward direction. Movement of ram 50 from its stationary position shown in FIG. 1 is initiated by a photocell 51 which senses the trailing edge of the next preceeding fabric ply to ply F being fed to folder 26. As the trailing edge of the next preceding fabric ply passes photocell 51, a solenoid actuates the piston of a pneumatic cylinder 52 to move the piston rod 53 axially. Cylinder 52 is supported by plate 54 and bar supports 55, 56, and 57. Piston 53 is pivotally connected to an arm 60 which, in turn, is rigidly connected to a bar 61 rotatably mounted in supports 57 and 62. Transfer blade or ram 50 is supported on a shaft 65, which is mounted rigidly on bar 61. When rod 53 is moved axially outward, arm 60 is rocked to rotate bar 61 and shaft 65 so that transfer blade or ram 50 moves downwardly to contact the fabric ply F. The bottom surface 70 of transfer blade or ram 50 is provided with a cloth covering 71 to minimize relative movement upon contact between the ply F and transfer blade or ram 50. Surface 70 is located a suitable distance from shaft 65 so that the fabric ply F can be transferred when struck to a moving belt 72 before the shaft 65 contacts the bottom surface 73 of a U-shaped guide 63 for shaft 65.

Figure 7:
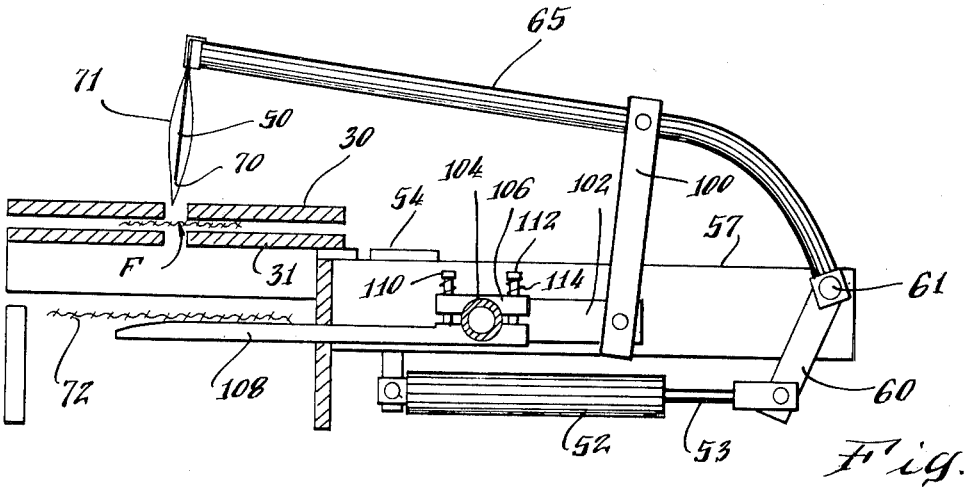
FIG. 7 is a cross-sectional view taken substantially along line 7—7 of FIG. 1, with certain parts omitted, and illustrates the transfer of the aligned fabric ply to a conveyor belt feeding the folding means.

When actuated, the surface 70 of transfer blade or ram 50 passes through opening 43 and cloth covering 71, contacts ply F and the ply F folds in half as shown in FIG. 7 and along with surface 70 and its cloth covering 71 passes through opening 44 and onto the moving belt 72, below alignment chamber 29. Surface 70 and its cloth covering 71 contacts the ply F along its central axis and maintains its relative position therewith during its downward movement until it contacts belt 72.

Figure 8:
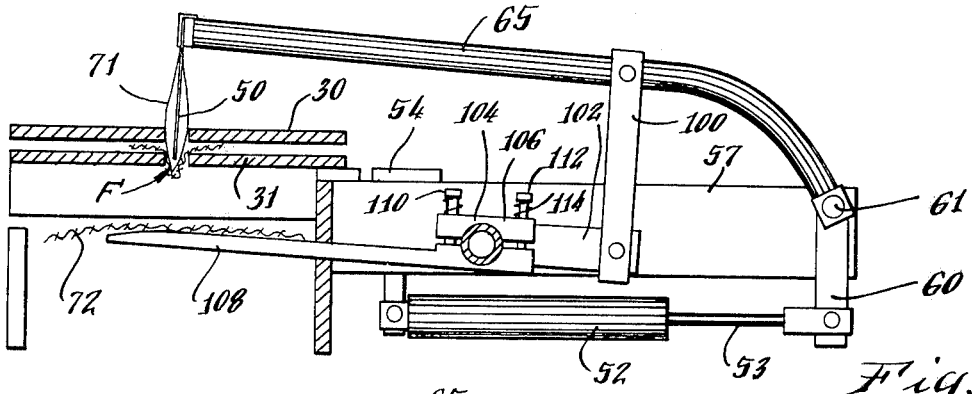
FIGS. 8–10 inclusive are views similar to FIG. 7, but illustrating subsequent steps in the transfer of the aligned fabric ply.
Figure 9:
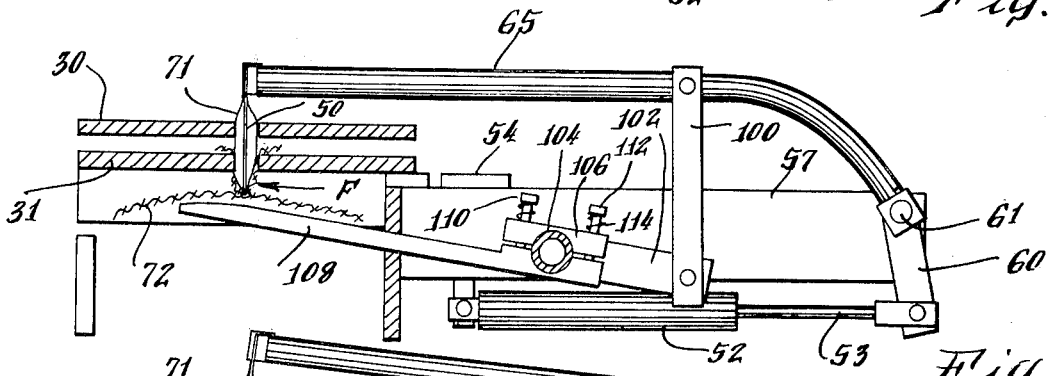
Figure 10:
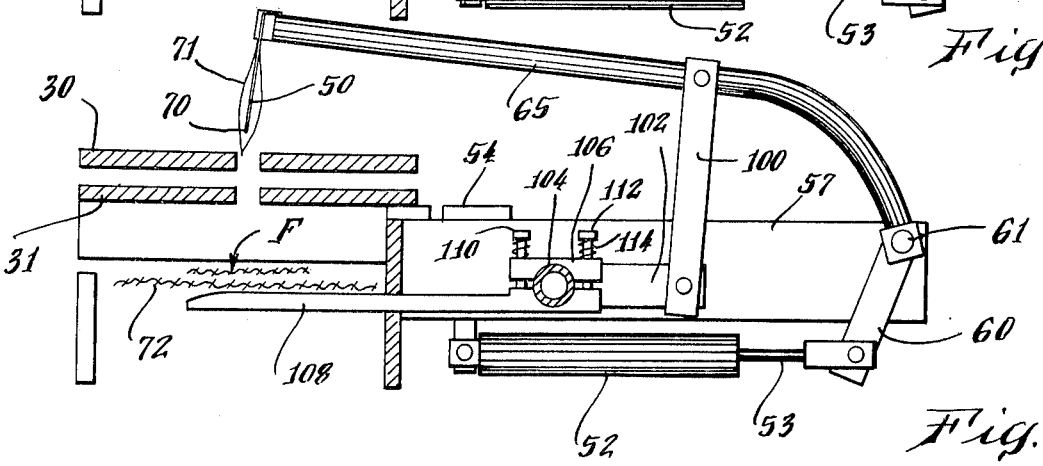

As shown in FIGS. 8–10, movement of the ply F during transfer and prior to contacting the belt 72 is minimized by raising the belt 72 as the ply F is forced through opening 44. This maintains the ply F in its aligned position relative to folder 26. In order to raise belt 72, a link 100 is fixed at one end to shaft 65 and at its opposite end to a link 102. Link 102 circumscribes a cylindrical shaft 104, which in turn is in frictional engagement between a plate 106 and an elongated arm 108 in contact with belt 72. Frictional contact between shaft 104 and plate 106 and arm 108 is maintained by a pair of screws 110, 112, inserted through plate 106 and threaded into arm 108. A spring 114 is placed between the head of each screw 110, 112 and plate 106.

When ram 50 contacts ply F as shown in FIG. 8, shaft 65 moves downwardly, causing rigid link 100 to move downwardly, moving link 102 upward and raising arm 108 and belt 72 towards descending ply F. Continued downward movement of shaft 65 causes belt 72 to be raised, as shown in FIG. 9 until ply F comes into contact with belt 72.

At this point, ply F will continue its downward travel by ram 50, but arm 108 will no longer rise because link 102 will frictionally rotate about shaft 104. The tension exerted by springs 114 will retain arm 108 in its inclined position of contact with ram 50 while link 102 pivots about shaft 104. In this manner, plates 106, arm 108, screws 110 and 112, and springs 114 constitute a clutch for rotating arm 108 until it contacts ram 50; the clutch releasing and precluding further movement of arm 108 when it contacts the ram 50. Upon deactuation of cylinder 52, the parts return to their original positions as illustrated in FIG. 10, while ply F is positioned on belt 72, still in alignment with folder 26. After the ply F is placed on the belt 72, the transfer blade or ram 50 is returned to the position illustrated in FIGS. 1 and 10 by deactuation of the solenoid valve and retraction of piston rod 53, as the leading edge 38 of ply F blocks photocell 51.

Belt 72 is an endless conveyor which is guided around rollers 73, 74, 75, 76 and 77. A second endless belt 81 acts in concert with belt 72 to deliver ply F to folder 26. Ply F rides on belt 72 and the top surface of ply F is pushed in synchronism by belt 81 to not only aid in moving the ply, but to maintain its alignment with folder 26. Belt 81 is passed around a driven roller (not shown) and is rotated 90 degrees from a vertical position back to a horizontal position. This driven roller is driven by the same motor as the sewing head and therefore plies F are fed in synchronization with movement of the sewing needles. A roller 95 provides tension control on the vertical portion of belt 81.

Figure 11:
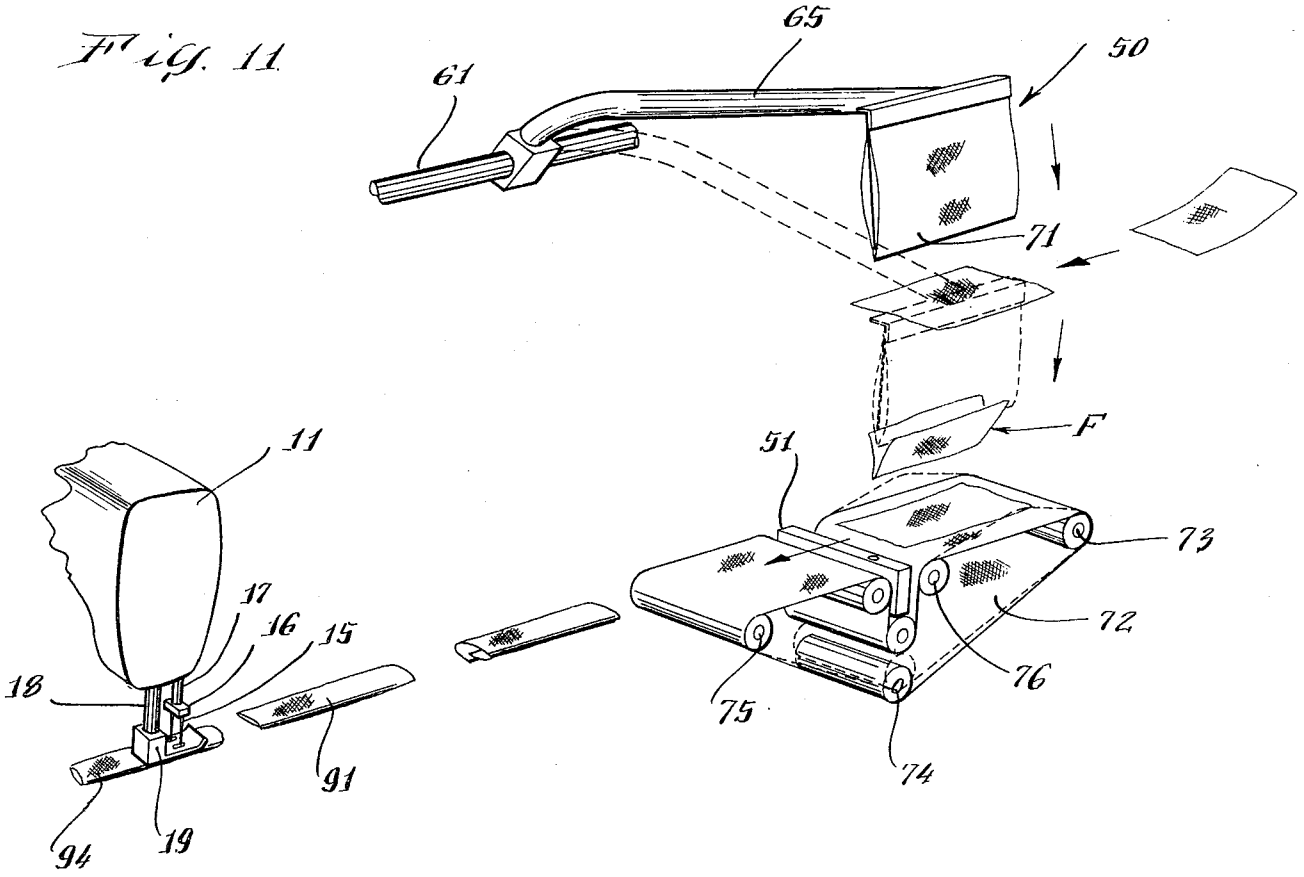
FIG. 11 is a diagrammatic view of the apparatus of FIG. 1, illustrating the process of the invention.

As shown in FIG. 11, ply F passes over photocell 51 when being transferred to the folder 26. When the trailing edge of ply F passes over photocell 51, pneumatic cylinder 52 and transfer blade or ram 50 are actuated to move the next succeeding ply 80 toward the belt 72, in spaced relation to ply F. After passing over photocell 51, the fabric ply F is contacted on its upper surface by moving belt 81, which, together with belt 72, moves the fabric ply 39 toward the entrance 82 of the folder 26.

The folder 26 is constructed so that folding of longitudinal edge 83 of the fabric ply F is initiated prior to folding of longitudinal edge 84. This can be accomplished by making folder 26 longer on one side so that the inclined edge 120 of folder 26 adjacent the entrance 82 to the folder will contact and deflect edge 83 first. Folder 26 converges from bottom to top so that as shown in FIGS. 5 and 6, folding of edges 83 and 84 is effected with edge 84 overlapping edge 83.

Figure 5:
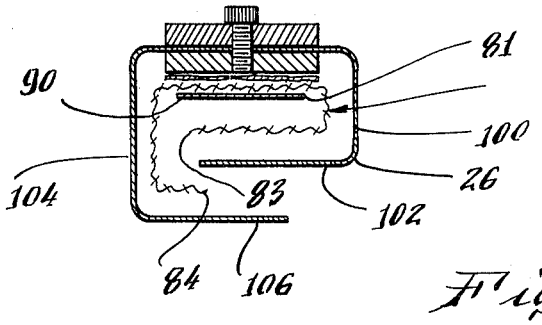
FIG. 5 is a cross-sectional view of the folding means taken along line 5—5 of FIG. 4.
Figure 6:
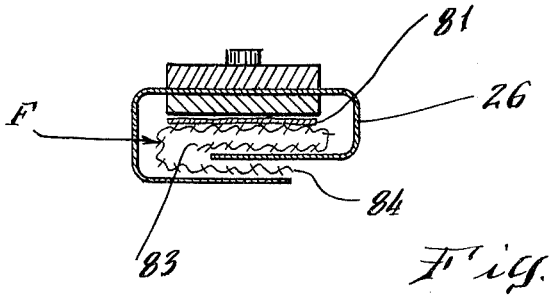
FIG. 6 is a cross-sectional view of the folding means taken along line 6—6 of FIG. 4.

As shown in FIGS. 5 and 6, folder 26 is substantially e-shaped in cross section and has a longer side wall 100. Side wall 100 has a lateral extension or shelf 102 which extends towards the opposite side wall 104, but stops short thereof. Similarly, side wall 104 has a lateral extension or shelf 106 which extends towards side wall 100, beneath shelf 102, but does not traverse the distance between the opposite side walls.

Upon entry of the ply F into folder 26, the leading edge of the wider ply will first contact inclined edge 120 of side wall 100 and longitudinal edge 83 of ply F will be deflected towards side wall 104 underneath the portion of ply F which fills the width of the folder 26. Shelf 102 provides a lower limit on the vertical deflection of edge 83. The opposite side of the leading edge of ply F will then contact inclined edge 122 of side wall 104 and longitudinal edge 84 will be deflected towards side wall 100. Shelf 106 provides a lower limit on the vertical deflection of edge 84 and since it is lower than shelf 102, edge 84 is deflected through the space between shelf 102 and side wall 104 and positioned beneath shelf 102 and edge 83.

Since folder 26 converges from its entrance 82 towards its exit 108 on an incline from bottom to top, the folded portions of ply F are brought towards each other.

Belt 81 is passed from a vertical to horizontal position over roller 86 and then threaded over roller 87, around roller 88 and through folder 26 to provide the desired contact with the fabric ply F on the belt 72 and in the folder 26. Upon exiting from folder 26, belt 81 is passed over roller 89 and back over roller 86. The ply F is removed from belt 72 by belt 81 and its bottom surface is contacted with a leaf spring clamp 90, which has a low friction surface as it enters the folder 26. Leaf spring 90 and belt 81 hold the ply F in clamped engagement therebetween as it is folded to maintain the alignment of the ply F and its exposed longitudinal edge 84 with needles 15 of sewing machine 10. The distance between roller 75 where belts 81 and 72 are separated and the end of leaf spring 90 within folder 26 is preferably less than half the length of the fabric ply F so that the trailing edge of the fabric ply is sandwiched between the belts 81 and 72 in proper alignment while folding of the leading edge of the fabric ply F is initiated thereby minimizing the possibility of misalignment of the fabric ply.

The folded ply 91 (FIG. 11 is removed from the folder 26 by belt 81 and inserted into guide 20 and thence under presser foot 19 to be sewn by needles 15 to form a belt loop. The belt loop is sewn so that lateral edge 84 is covered with stitches along its entire length. The belt loops are sewn continuously and are sequentially spaced to form a chain of belt loops 94 joined by open stitches which can be separated easily by cutting the open stitches.

By use of the apparatus disclosed, fabric can be cut to the exact length and width needed for the finished belt loop and inserted singly through opening 27 to exit from the sewing section D in a finished loop whose exposed edge is precisely stitched so that it will not unravel.

The present invention relates to methods and apparatus for producing parts, such as garment components, from pre-cut pieces of cloth or cloth-like materials. While the invention described applies to the making of belt loops for garments, the novel principles herein disclosed have obvious application to the manufacture of other articles made from material such as fabric.

FIG. 11 shows a typical belt loop before it has been sewn to a garment. It consists of a piece of fabric which is folded into a tubular shape and stitched in order to secure a flat form. A double row of stitches is shown in the example. Variations in the type of stitch are frequently employed as are differences in the fold (such as felling), and the addition of stiffening materials to give more body to the loop. These variations can be accommodated by obvious minor changes in the apparatus herein described.

What is claimed is:

1. Apparatus for making a belt loop from a fabric piece comprising:

means for folding the fabric piece to overlap longitudinal edges of the fabric piece along its length so as to provide a hidden longitudinal edge and an overlapped exposed longitudinal edge, means for presenting the fabric piece in stationary alignment with respect to said means for folding the fabric piece, and means for transporting the fabric piece to said folding means while maintaining the alignment of the fabric piece with respect to the folding means, said means for presenting the fabric piece in stationary alignment including:

a chamber, means for introducing a pressurized fluid into said chamber, deflecting means within said chamber for changing the direction of flow of said pressurized fluid, said means for introducing said fluid and said deflecting means being arranged to flow a portion of the fluid into contact with and generally parallel to the longitudinal edge of the fabric piece and to flow a portion of the fluid into contact with and generally perpendicular to said longitudinal edge, and stop means within said chamber to contact a lateral edge of the fabric piece and a longitudinal edge of the fabric piece to position the fabric piece in contact with said fluid flow in stationary alignment with respect to said folding means, said means for transporting the aligned fabric piece to the folding means including:

a transfer blade for contact with the aligned fabric piece in said chamber, means for passing the transfer blade and aligned fabric piece through said chamber, and a moving belt means positioned to receive said aligned fabric piece from said chamber and transfer blade and to transport said aligned fabric piece to said folding means, said moving belt means including:

means for raising said moving belt means towards said chamber as said transfer blade contacts said fabric piece.

2. The apparatus of claim 1 adapted for making a plurality of belt loops in sequence including:

means for moving said transfer blade into contact with said fabric piece, means for sensing the trailing edge of the fabric piece next preceding the aligned fabric piece on said belt means, and means for initiating movement of the transfer blade in response to said sensing means sensing the trailing edge of the fabric piece next preceding the aligned fabric piece.

3. Apparatus in accordance with claim 1, wherein said folding means includes:

an elongated member having an entrance and an exit for said fabric piece, said entrance being defined by a pair of spaced edges which initiate folding of said fabric piece through contact therewith, one of said edges being disposed upstream from the other in the direction of fabric movement.

4. Apparatus in accordance with claim 3, wherein said spaced edges are inclined.

5. Apparatus in accordance with claim 4, wherein said elongated member is substantially e-shaped in cross section, wherein each of the side walls of said elongated member includes one of said inclined edges and a lateral extension in the direction of the other side wall, one of said lateral extensions being underneath the other and each of said extensions having a length shorter than the distance between the side walls of said elongated member.

6. Apparatus in accordance with claim 5, wherein said elongated member converges from its entrance to its exit on an incline from bottom to top.

7. Apparatus for making a belt loop from a fabric piece comprising:

means for folding the fabric piece to overlap longitudinal edges of the fabric piece along its length so as to provide a hidden longitudinal edge and an overlapped exposed longitudinal edge, means for stitching the exposed overlapped longitudinal edge of said fabric piece, pneumatic means for stationarily aligning said fabric piece with said folding means so that the overlapped exposed longitudinal edge of said fabric piece formed by said folding means will be subsequently covered by the stitches from said stitching means, and means for transporting the fabric piece to said folding means while maintaining the alignment of the fabric piece with respect to the folding means including a chamber, said pneumatic means introducing pressurized air into said chamber, deflecting means within said chamber for changing the direction of flow of said pressurized air, said pneumatic means and said deflecting means being arranged to flow a portion of the air into contact with and generally parallel to the longitudinal edge of the fabric piece and to flow a portion of the air into contact with and generally perpendicular to said longitudinal edge, and stop means within said chamber to contact a lateral edge of the fabric piece and a longitudinal edge of the fabric piece to position the fabric piece in contact with said air flow into the desired alignment with said folding means, said means for transporting the aligned fabric piece to the folding means including:

a transfer blade for contact with the aligned fabric piece in said chamber, means for passing the transfer blade and aligned fabric piece through said chamber, and a moving belt means positioned to receive said aligned fabric piece from said chamber and transfer blade and to transport said aligned fabric piece to said folding means, said moving belt means including means for raising said moving belt means towards said chamber as said transfer blade contacts said fabric piece.

8. Apparatus comprising means for transporting a plurality of pliable sheets of material sequentially into stationary orientation, and means for conveying said sheets of material to a subsequent work station while maintaining their individual orientation, said means for transporting said plurality of pliable sheets of material including:

a chamber, means for introducing a pressurized fluid into said chamber, deflecting means within said chamber for changing the direction of flow of said pressurized fluid, said means for introducing said fluid and said deflecting means being arranged to flow a portion of the fluid into contact with and generally parallel to a longitudinal edge of one of the sheets of material and to flow a portion of the fluid into contact with and generally perpendicular to said longitudinal edge, and stop means within said chamber to contact a lateral edge of said sheet of material and a longitudinal edge of said sheet of material to position the sheet of material in contact with said fluid flow in stationary orientation, said means for conveying said sheets of material including a transfer blade for contact with the aligned sheet of material in said chamber, means for passing the transfer blade and aligned sheet of material through said chamber, and a moving belt means positioned to receive said aligned sheet of material from said chamber and transfer blade and to transport said aligned sheet of material to a subsequent work station, said moving belt means including means for raising said moving belt means towards said chamber as said transfer blade contacts said sheet of material.

* * * * *